United States Patent [19]

Nixon, Jr.

[11] 4,180,755

[45] Dec. 25, 1979

[54] SEALED BEAM LAMP INCLUDING FILAMENT LOCATING MEANS

[75] Inventor: Roy A. Nixon, Jr., Greenville, Ohio

[73] Assignee: Corning Glass Works, Corning, N.Y.

[21] Appl. No.: 942,602

[22] Filed: Sep. 15, 1978

Related U.S. Application Data

[62] Division of Ser. No. 749,450, Dec. 10, 1976, Pat. No. 4,125,890.

[51] Int. Cl.[2] ..... H01K 1/18; H01K 1/32

[52] U.S. Cl. ..... 313/113

[58] Field of Search ..... 313/113, 115; 362/347, 362/348

[56] References Cited

U.S. PATENT DOCUMENTS

| | | | |
|---|---|---|---|
| 2,880,347 | 3/1959 | Flaws, Jr. et al. | 313/113 X |
| 3,153,168 | 10/1964 | Saranga | 313/113 |

*Primary Examiner*—Palmer C. Demeo

*Attorney, Agent, or Firm*—Richard E. Kurtz; John P. DeLuca; Burton R. Turner

[57] ABSTRACT

In a sealed beam incandescent lamp a generally concave reflector member is provided with three or more bosses having flat outer surfaces. The surfaces define a plane perpendicular to the axis of the parabola so that specific points within the parabola can be located with great precision. By using the bosses as reference points, lamp filaments can be accurately placed within the lamp structure, regardless of variations in the reflector member which occur during the manufacturing process.

6 Claims, 3 Drawing Figures

SEALED BEAM LAMP INCLUDING FILAMENT LOCATING MEANS

This is a division of application Ser. No. 749,450, filed Dec. 10, 1976, now U.S. Pat. No. 4,125,890.

BACKGROUND OF THE INVENTION

The present invention relates to incandescent lamps, and more particularly to lamps of the sealed-beam type which utilize a preformed reflector member.

Sealed beam lamps, particularly those of the type commonly used with motor vehicles, commonly comprise an envelope formed by a monolithic reflector member which is joined to a lens member to form an evelope enclosing one or more filaments. The reflector member is conventionally concave in form, its inner surface being generally parabolic. As is commonly known, when using a parabolic reflector it is advantageous to place the source of illumination as close to the focal point of the parabola as possible. Moreover when using two or more filaments, while it is obviously impossible to place both filaments at the focal point, it is still important that the filaments remain in the focal plane or latus rectum of the parabola.

Despite the fact that sealed beam lamps have been manufactured for decades and a great deal of effort has been expended in improving both their design and manufacturing techniques, the accurate placement of lamp filaments during the manufacture of the lamps has continued to be a problem. In particular, it has been found difficult to repeatedly and accurately place the lamp filaments in the desired relationship to the parabolic reflector curve preparatory to the permanent affixation of the filament and/or mounting members to the reflector body.

As will be recognized by those skilled in the art, sealed beam reflector members are commonly made of pressed glass, and formed by placing molten glass in a generally concave mold, then urging a ram having a formed, parabolic head into the mold to press the molten glass into the desired configuration.

When it is subsequently desired to place lamp filaments within the reflector, it is common to use a fixture in which the outer (convex) surface of the concave reflector member seats, then to bring a set of three alignment fingers into contact with the inner reflector surface. When the locating fingers have seated upon the reflector surface it is assumed that the mounting head carrying the fingers is in a desired relationship with the reflector surface. This relationship is relied up in supporting the lamp filaments at a predetermined position with respect to the fingers while the rigid filament mounting leads are permanently affixed to the filaments.

In theory, the foregoing procedure should provide a highly accurate, repeatable registration of the filaments with respect to the reflector surface. However, due to manufacturing tolerances and unforseen or irregular shrinkage or distortion of the reflector, or to a slight misregistration of the glass-pressing punch with respect to its cooperating mold, accurate location of the filament within the reflector is not consistently achieved.

In particular, a slight shift or misregistration of the punch with respect to the glass-pressing mold causes a commensurate shift of the reflector inner surface with respect to the fixture which receives the outer reflector surface during the filament mounting operation. In such a case, or in the event that the reflector member has been warped slightly during the cooling process, the locating fingers of the filament-mounting fixtures do not encounter the same areas of the reflector parabola in every instance. As a result, placement of the filament within the reflector member is irregular, causing the optical properties of the finished lamp assemblies to be irregular.

Accordingly, it will be appreciated that it would be highly desirable to provide means for accurately locating a filament within a sealed beam lamp reflector.

It is therefore an object of the present invention to provide an improved reflector susceptible of more accurate filament location than hereinbefore possible.

Another object of the present invention is to provide a parabolic reflector whose configuration allows a precise determination of predetermined points of the parabola.

Yet another object is to provide a generally parabolic reflector with locating means from which the latus rectum of the parabola may be inferred.

SUMMARY OF THE INVENTION

Briefly stated, in accordance with one aspect of the invention the foregoing objects are achieved by providing a concave reflector member for an incandescent sealed beam lamp with at least three discrete, upstanding bosses whose surfaces define a plane approximately perpendicular to the plane of the parabola for receiving locating means. In one embodiment, a reflector having a generally circular periphery is provided with three bosses located at approximately 120° intervals about the interior surface of the reflector, the bosses defining a plane substantially coincident with the latus rectum of the parabola defining the reflector surface.

In another embodiment the reflector terminates in a substantially rectangular periphery and four locating bosses are provided, each adjacent a corner of the rectangle defined by the reflector periphery.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
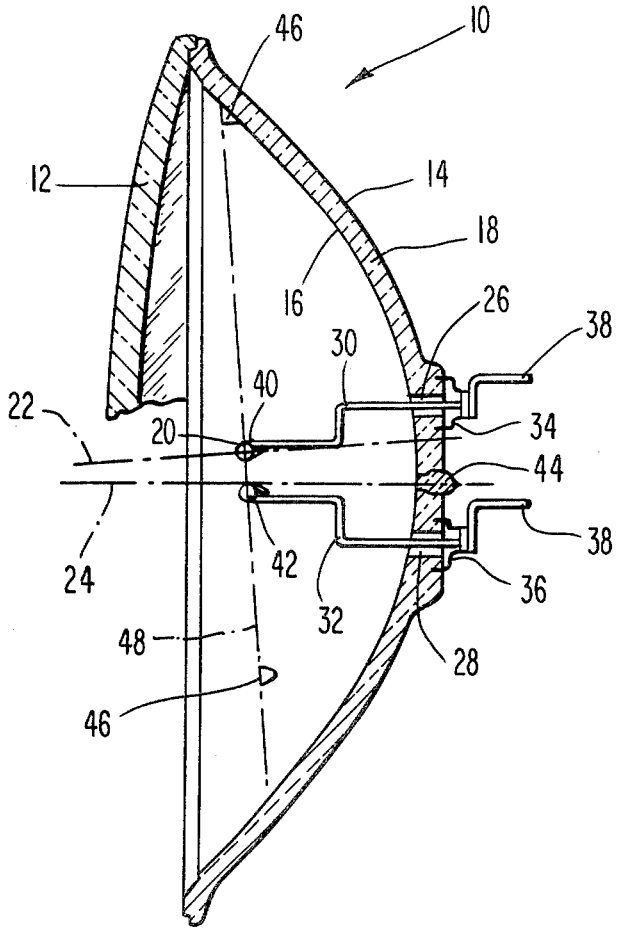
FIG. 1 is a sectional view of a circular sealed beam lamp formed in accordance with the subject invention.

FIG. 1 depicts a sealed beam lamp generally indicated at 10, of the type conventionally used in a motor vehicle. The lamp envelope is comprised of a lens member 12 and a concave reflector member 14 which are joined at their peripheries so as to afford an air-tight seal, for instance by fusing the abutting surfaces with flames. Reflector member 14 comprises inner and outer surfaces 16, 18 respectively. The outer surface 18, while generally parallel to the inner, concave surface does not necessarily display the precise contour that the inner, reflecting surface need have. Conventionally, the inner surface is defined by a parabola having a focal point 20 and an axis 22.

As is apparent from FIG. 1, the axis 22 of the parabola is tilted with respect to the axis of symmetry of the reflector 24, which may be considered to be generally perpendicular to the plane of the reflector periphery. Further, the reflector member is provided with apertures 26, 28 through which rigid leads 30 and 32 extend. The leads are secured to ferrules 34 and 36 to both seal the lamp envelope and to provide electrical continuity to contact terminals 38. The inner surface of the reflector is aluminized to afford a highly reflective surface.

At the outermost ends of the rigid leads are disposed a pair of light-producing filaments 40, 42. As is familiar to those skilled in the art, these filaments commonly comprise coils of fine wire of a refractory material such as tungsten.

An exhaust tubulation 44 is sealed to the envelope and affords a port through which air can be evacuated from the lamp assembly, and an inert gas introduced. Subsequent to this operation the tubulation is "tipped off" by fusing the surrounding glass in the manner shown so as to provide a permanent, airtight seal.

According to the present invention, a plurality of bosses 46 are formed within the reflector member, advantageously upstanding from the surface of the reflector and terminating in aligned, flat surfaces which define a plane 48. While in some circumstances it may be possible to form the necessary bosses by indentations in the reflector body, such indentations will weaken the body and accordingly, protruding bosses of the type illustrated in the Figure are preferred. Further, while the illustrated bosses take the form of segments of right cylinders, it should be recognized that for any given application various configurations may be selected, and the illustrated configurations are shown by way of example rather than limitation.

In order to take full advantage of the locating bosses provided in the Figure, the jig or fixture used to locate the filament and leads within the reflector is provided with a set of three fingers which terminate at surfaces formed from sall spheres or the like. After the reflector member is placed in a nest or other receptacle, the locating fingers are lowered and the reflector aligned so that all fingers may contact all of the bosses. Since the relationship of the bosses with respect to the focal point of the parabola is predetermined, in the present instance the focal point being in the plane of the bosses, the filaments may be accurately mounted in the latus rectum by aligning them with the lower ends of the locating fingers. In this manner the locating fixture can repeatedly locate the filament with great accuracy, inasmuch as consistent location of the filaments with respect to the sensing finger end is easily achieved through proper fixture design.

The ends of rigid leads 30, 32 are affixed to the reflector in conventional fashion, for instance, by brazing them to ferrules 34, 36. After the brazing step is complete the filaments are disposed in a desired position by the locating fixture and the protruding ends of the rigid leads clamped upon the ends of the filaments.

A closer examination of FIG. 1 will reveal that only filament 40 is actually coincident with the focal point of the parabolic lens surface. Obviously, only one filament may be coincident with a given point; nonetheless, it is important that filament 42 lie in the latus rectum. Theoretically the ideal placement of a light source, e.g. a filament, is in the latus rectum at the focal point of a parabola. It is recognized, however that small deviations occur and, within limits, are tolerable. Lateral deviations from the parabolic axis, however, are less significant than are axial deviations, that is, departures of the light source from the latus rectum. Accordingly, by providing defined locating points within the reflector member which are always at a predetermined position with respect to the latus rectum of the parabola, improved accuracy and repeatability of filament mounting can be achieved.

A highly advantageous feature of the present invention is that the locating bosses may be formed by suitable indentations machined in a conventional reflector pressing ram. Since it is the ram surface which actually defines the parabolic reflector curve, the relationship of the locating bosses to the parabolic curve necessarily remains constant even despite misregistration of the ram with respect to the mold which receives it.

As will be recognized by those skilled in the art, in actual practice parabolic reflector surfaces comprise "spread light" areas and "hot spot" areas which respectively disperse and concentrate light emitted by a filament. Irregularities in "hot spot" or concentrating areas of a reflector can severely perturb the pattern of light from the reflector; irregularities in the "spread light" areas do not produce significant effects. Accordingly, the present invention comprehends the disposing of locating bosses 46 in a spread light area of the reflector surface.

It has been found that the annular surface surrounding the filament, and lying generally about the intersection of the latus rectum with the reflector surface, comprises spread light areas. Still further, the present inventor has determined that, although pressed glass reflectors undergo a certain degree of shrinkage and/or warpage, the area about the intersection of the latus rectum with the reflector surface generally maintains its integrity with respect to the parabolic locus of the reflector. Accordingly, it has been found that by disposing the locating bosses generally coplanar with the latus rectum of the parabola the integrity and repeatability of the reference plane is substantially enhanced.

In a presently preferred embodiment the locating bosses are each located in spread light areas lying about the intersection of the latus rectum and the reflector surface, and between ones of the hot spot areas.

Upon gaining an understanding of the present invention it should be apparent to those skilled in the art that it is not absolutely necessary for the plane defined by the bosses to lie in the latus rectum. As long as the relationship of the boss surfaces to the latus rectum is a fixed quantity, appropriate dimensioning of the filament-locating fixture can easily be accomplished so that the lamp filament can be consistently placed in the latus rectum. It has been found desirable in practice, however, to dispose the locating bosses such that the plane they define is perpendicular to the axis of the parabola. Still further, and consistent with good engineering practice for a lamp having annular symmetry, i.e. one whose periphery is generally circular, the locating bosses may be spaced about the reflector surface at intervals of substantially 120°.

Figure 2:
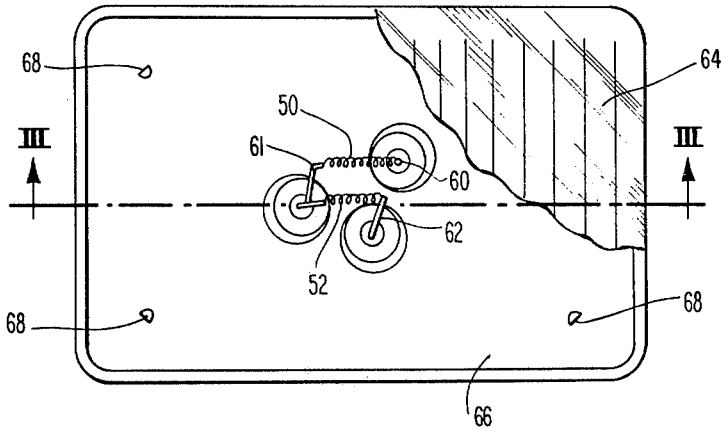
FIG. 2 is a partially sectioned frontal view of a rectangular sealed beam lamp incorporating the present invention.

Turning now to FIG. 2 there is shown a sealed beam lamp of a rectangular shape, similar to those recently employed for vehicle headlamps. As is the case with circular lamps, the inner surface of the reflector member of the envelope is provided with a substantially parabolic curve. A pair of filaments 50, 52 are supported by rigid leads 60, 61 and 62 as shown and are disposed in the latus rectum of the parabola defining the lamp reflector. Lens member 64 is shown in partially sectioned form so that the inner surface 66 of the reflector may be seen, along with the filament assembly mounted therein. Also visible are three of four locating bosses 68. Although it is recognized that only three such bosses are needed to define a plane, in the case of rectangular lamps it has been found advantageous to provide four such bosses. In a preferred embodiment, the bosses are located adjacent the corners of the rectangle defined by the periphery of the reflector member.

Figure 3:
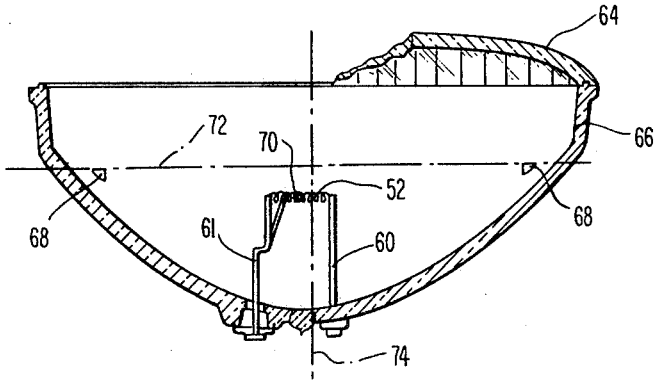
FIG. 3 is a view taken at III—III of FIG. 2.

FIG. 3, a sectional view taken at III—III of FIG. 2, illustrates in further detail the construction of the rectangular lamp assembly. The focal point 70 of the parabola defined by the inner surface 66 of the reflector member is substantially coincident with filament 52, but substantially below the plane 72 defined by the locating bosses. As set forth above, this does not detract from the ability of a properly designed locating fixture to dispose the filaments of the lamp in the required position, inasmuch as the relationship of the plane of the bosses to the latus rectum of the parabolic curve is known and substantially invariant.

Further, in the embodiment of FIG. 3 the plane defined by the locating bosses 68 may be perpendicular to the axis 74 of the lamp assembly, despite the fact that the lamp assembly axis and the axis of the parabola are neither coincident nor parallel. This has been found to be advantageous in practice and presents no serious obstacle to mounting fixture design since, as discussed hereinabove, the relationship of the mounting bosses to the parabolic reflector surface is fixed so that accurate, repeatable filament placement can be attained.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A sealed beam incandescent lamp, comprising:

a lens member for refracting a beam of light emanating from within the lamp;

a generally concave reflector member attached to said lens member to form a lamp envelope, said reflector member exhibiting a substantially parabolic transverse section;

a filament assembly fixedly attached to said reflector member, and including a filament member disposed approximately in the latus rectum of the parabola; and at least three discrete bosses formed in the inner surface of said reflector member, said bosses defining a plane substantially perpendicular to the axis of said parabola such that said bosses enable the accurate mounting of the filament at the latus rectum of the lamp.

2. A lamp according to claim 1, wherein said inner surfaces of said reflector member define spread light and light concentration areas for respectively dispersing and concentrating light from said filament, each of said bosses being disposed in a spread light area.

3. A lamp according to claim 2, wherein said bosses comprise discrete planar surfaces extending generally perpendicular to the axis of the parabola.

4. A lamp according to claim 3, wherein said plane defined by said bosses substantially coincides with the latus rectum of the parabola.

5. A lamp according to claim 4, wherein said reflector member terminates in a substantially circular periphery, and said bosses are disposed approximately 120° apart within said reflector member.

6. A lamp according to claim 4, wherein said reflector member terminates in a substantially rectangular periphery, there being at least four discrete bosses in said inner surface, each of said bosses being disposed adjacent a corner of the rectangle defined by the periphery of the reflector member.

* * * * *